US010593193B2

(12) United States Patent
Kuhn-Matysiak

(10) Patent No.: US 10,593,193 B2
(45) **Date of Patent: *Mar. 17, 2020**

(54) METHOD AND DEVICE FOR CALIBRATING A SMOKE DETECTOR

(71) Applicant: Siemens Schweiz AG, Zurich (CH)

(72) Inventor: Ulrich Kuhn-Matysiak, Staufen (DE)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/191,842

(22) Filed: Nov. 15, 2018

(65) Prior Publication Data

US 2019/0164415 A1 May 30, 2019

(30) Foreign Application Priority Data

Nov. 24, 2017 (EP) ..... 17203453

(51) Int. Cl.
*G08B 29/26* (2006.01)
*G08B 29/20* (2006.01)
*G08B 17/103* (2006.01)

(52) U.S. Cl.
CPC ..... *G08B 29/26* (2013.01); *G08B 17/103* (2013.01); *G08B 29/20* (2013.01)

(58) Field of Classification Search
CPC ..... G08B 1/00; G01N 1/00
See application file for complete search history.

(56) References Cited

U.S. PATENT DOCUMENTS 5,497,144 A 3/1996 Schäppi et al. ..... 340/630
2018/0308346 A1* 10/2018 Allemann ..... G08B 29/20

FOREIGN PATENT DOCUMENTS

CN 101923767 A 12/2010 ..... G08B 17/10
CN 102654934 B 1/2014 ..... G08B 17/10
CN 105136978 B 3/2017 ..... G01N 33/00
EP 0 658 264 B1 4/1998 ..... A62C 37/50
EP 3 392 855 A1 10/2018 ..... G08B 29/20

OTHER PUBLICATIONS

Ellwood, "Distributed Optical Smoke Sensor Calibration," AW Technology Limited, 4 pages, Jun. 27, 2012.

* cited by examiner

*Primary Examiner* — Shirley Lu
(74) *Attorney, Agent, or Firm* — Slayden Grubert Beard PLLC

(57) ABSTRACT

Various embodiments may include a method for the automatic calibration of a smoke detector comprising: mounting the smoke detector in a channel with an aerosol flow, along with a reference smoke detector; calibrating the smoke detector with data received by the reference detector. The reference detector comprises a scattered light receiver and a scattered light transmitter defining a scattered light plane. The aerosol flow through the channel flows through the reference detector transversely to the scattered light plane.

10 Claims, 6 Drawing Sheets

METHOD AND DEVICE FOR CALIBRATING A SMOKE DETECTOR

CROSS-REFERENCE TO RELATED APPLICATIONS

This application claims priority to EP Application No. 17203453.0 filed Nov. 24, 2017, the contents of which are hereby incorporated by reference in their entirety.

TECHNICAL FIELD

The present disclosure relates to smoke detectors. Various embodiments may include a method for calibrating a smoke detector or at least one smoke detector (calibration method) and a device operating according to the method for calibrating a smoke detector or at least one smoke detector (calibration device).

BACKGROUND

Smoke detectors are often built from low-cost components, for example LEDs, which in some cases differ significantly in terms of their characteristic properties (component scattering). Despite this, the sensitivity of all smoke detectors should be as similar as possible. This is not only relevant for use in the field, but, within certain limits, is also required by approval bodies. A smoke detector can, for example, be calibrated by immersing a scattering or reflecting object into the scattered light region, for example in that the immersed object is embodied as a diffuser, such as described in EP 0 658 264 B1.

A widely used method for calibrating smoke detectors is calibration in a so-called smoke channel in which, with regard to a throughput commensurate with mass production, typically a large number of smoke detectors are mounted on a carrier plate and tested jointly in the smoke channel. This gives rise to the problem that, due to turbulence and inhomogeneities in the distribution of the test aerosol flowing through the smoke channel, not all smoke detectors are exposed to the same aerosol conditions thus resulting in errors. Moreover, in particular due to the space required by smoke channels commonly used to date, calibration in a smoke channel is difficult to integrate into mass production.

A description entitled "Distributed Optical Smoke Sensor Calibration" from the UK company AW Technology Limited discloses a further method for testing smoke detectors. Herein, a scattered light sensor (smoke scatter sensor) is attached to a smoke channel in addition to the obscuration sensor always comprised thereby. This operates using a fan that conveys aerosol from the smoke channel into a sensor chamber of the scattered light sensor. The sensor chamber is connected to a channel in which one or more smoke detectors are located. Therefore, the smoke channel so-to-speak functions as an aerosol source for the volume flow conducted through the channel. Although, according to this description, calibration of the smoke detector is supposed to be possible, the manner in which calibration is to be performed is not described.

SUMMARY

The teachings of the present disclosure may enable a simple and efficient method for calibrating a smoke detector and a corresponding device. With this method, the following is provided in accordance with the approach suggested here: the at least one smoke detector to be calibrated is placed in a channel exposed to an aerosol flow. For example, some embodiments may include a method for the automatic calibration of at least one smoke detector (10), wherein the at least one smoke detector (10) to be calibrated is placed in a channel (28) exposed to an aerosol flow (26), wherein, together with the at least one smoke detector (10) to be calibrated, at least one smoke detector that also functions as a reference detector (30) and has already been calibrated is located in the channel (28), wherein the at least one smoke detector (10) to be calibrated is calibrated by means of data (42) that can be received by the reference detector (30), wherein the reference detector (30) comprises as sensing means in a scattered light plane (24) at least one scattered light receiver (14) and at least one scattered light transmitter (16) and wherein the aerosol flowing (26) through the channel (28) flows through the reference detector (30) in the channel (28) transversely to the scattered light plane (24) of the reference detector (30).

In some embodiments, the reference detector (30) is placed in the channel (28) without a housing (12) surrounding the sensing means of the reference detector (30).

In some embodiments, the reference detector (30) is placed in a reference detector housing (38) belonging to the channel (28).

In some embodiments, an orientation of a scattered light transmitter (16) of the reference detector (30) is adapted to an orientation of a corresponding scattered light transmitter (16) of the at least one smoke detector (10).

As another example, some embodiments include a device for the automatic calibration of at least one smoke detector (10), wherein the device (10) comprises a channel (28) that can be exposed to an aerosol flow (26), wherein the at least one smoke detector (10) to be calibrated can be placed in the channel (28), wherein, together with the at least one smoke detector (10) to be calibrated, at least one already calibrated smoke detector that functions as a reference detector (30) can be placed in the channel (28), wherein the device is able to transmit data (42) that can be received by the reference detector (30) to the at least one smoke detector (10) to be calibrated for the calibration thereof, wherein at least the reference detector (30) comprises as sensing means in a scattered light plane (24) at least one scattered light receiver (14) and at least one scattered light transmitter (16) and wherein the aerosol flowing (26) through the channel (28) can flow through the reference detector (30) in the channel (28) transversely to the scattered light plane (24) of the reference detector (30).

In some embodiments, the channel (28) comprises at least one smoke detector housing (36) to accommodate the at least one smoke detector (10) to be calibrated, and a respective reference detector housing (38) to accommodate the reference detector (30), wherein the housings (36, 38) comprised by the channel (28) are connected to each other by means of channel sections (34) such that each output side of a housing (36, 38) is connected to an input side of a downstream housing (36, 38) along the channel (28) and wherein the reference detector housing (38) is intended and configured to accommodate a reference detector (30) in precisely one orientation, namely an orientation in which the aerosol flowing (26) through the channel (28) flows through the reference detector (30) in the channel (28) transverse to scattered light plane (24) of the reference detector (30).

In some embodiments, in order to concentrate the aerosol flow in a scattered light region (20) of the reference detector (30) located in the reference detector housing (38), a channel section (34) connected upstream to the reference detector housing (38) or to one of the reference detector housings (38) extends piece-by-piece into the reference detector housing (38).

In some embodiments, a cross section of a channel section (34) connected downstream to the reference detector housing (38) or to one of the reference detector housings (38) is larger than a cross section of a channel section (34) connected upstream to the same reference detector housing (38).

In some embodiments, a position of at least one scattered light transmitter (16) of the or a smoke detector functioning as a reference detector (30) is variable.

As another example, some embodiments include a computer program (46) with program code means for controlling or monitoring the device according to the description above, wherein under control of the computer program (46), sensor signals (42) of the reference detector (30) and/or the at least one smoke detector (10) to be calibrated are processed for the calibration of the at least one smoke detector (10) to be calibrated.

In some embodiments, there is a control unit (44) and a memory into which a computer program (46) is loaded for execution during the operation of the device by the control unit (44).

DETAILED DESCRIPTION

Figure 1:
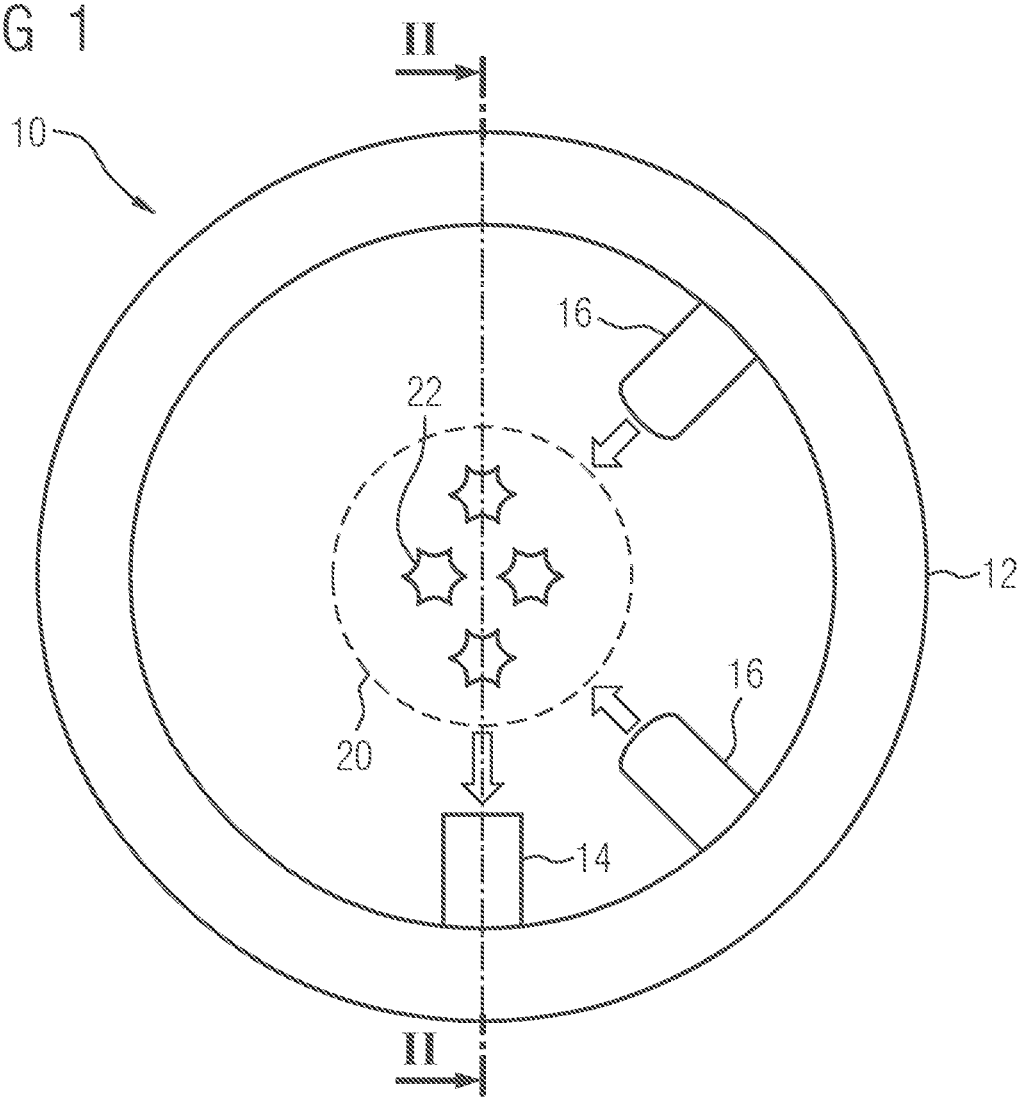
FIG. 1 shows a smoke detector incorporating teachings of the present disclosure in a top view with a view of the sensing means comprised by the smoke detector and a scattered light region enclosed by the sensing means.

In some embodiments, together with the at least one smoke detector to be calibrated, at least one already calibrated smoke detector, which is in particular of the same type, that functions as a reference indicator is located in the channel. Automatic calibration of the at least one smoke detector takes place in that it is calibrated by means of data that can be received by the reference detector. In addition, the following is provided with respect to the positioning of the at least one reference detector in the channel: the reference detector is arranged in the channel in a manner that ensures that the aerosol flowing through the channel flows through the reference detector transversely (perpendicularly or at least substantially perpendicularly) to a scattered light plane of the reference detector. Herein, the scattered light plane of the reference detector is formed as a result of the sensing means comprised by the reference detector. The sensing means include at least one receiver and at least one transmitter for scattered light (scattered light receiver, scattered light transmitter). The sensing means define the scattered light plane and are consequently located in the scattered light plane. The flow through the reference detector transverse to the scattered light plane enables a through-flow with which the aerosol flow does not come into contact with, or at least substantially does not come into contact with, the sensing means.

In some embodiments, a device for the automatic calibration (calibration device) of at least one smoke detector comprises a channel that can be exposed to an aerosol flow. The at least one smoke detector to be calibrated can be placed in the channel together with at least one already calibrated smoke detector that functions as a reference detector, in particular with at least one calibrated, smoke detector of the same type. Instead of a calibrated smoke detector of the same type, also suitable as a reference detector is a scattered light arrangement of a smoke detector or for a smoke detector, namely a scattered light arrangement with at least one scattered light receiver and at least one scattered light transmitter and with the same scattering angles as the at least one smoke detector to be calibrated. The same applies to the present method and to all embodiments described below and, correspondingly, with respect to the present innovation, each mention of a reference detector or of a smoke detector functioning as a reference detector should also be understood to mean such a scattered light arrangement, namely a scattered light arrangement functioning as a reference detector and with this reference should be deemed to be incorporated by the description presented here.

In some embodiments, during the operation of the device and for the calibration of the at least one smoke detector to be calibrated, the at least one smoke detector to be calibrated and the at least one reference detector are placed in the channel. The automatic calibration of the at least one smoke detector is performed in that the device transmits data that can be received by the reference detector to the at least one smoke detector to be calibrated for the calibration thereof. With respect to the positioning of the at least one reference detector in the channel, it is also provided with the device that the reference detector is arranged in the channel in a manner that ensures that the aerosol flowing through the channel flows through the reference detector transversely (perpendicularly or at least substantially perpendicularly) to a scattered light plane of the reference detector.

To avoid unnecessary repetitions, in the further description features and details described in connection with said calibration method and any embodiments obviously also apply in connection with and in respect of the calibration device configured to perform the method and vice versa. Accordingly, the calibration method can also be developed by means of individual or several method features that relate to the method steps carried out by the calibration device and the calibration device can also be developed by means for carrying out method steps carried out within the context of the calibration method. Consequently, features and details described in connection with said calibration method and any embodiments obviously also apply in connection with and in respect of the calibration device intended to perform the calibration method and vice versa in each case so that mutual reference is, or can be, always applicable with respect to the disclosure of individual aspects of the invention.

In some embodiments, the attachment of the reference detector with a scattered light plane transverse to direction of flow of the aerosol flow through the channel enables it to be ensured that the aerosol does not, or at least substantially does not, come into contact with the sensing means of the reference detector. If the aerosol does not come into contact with the sensing means of the reference detector, or only comes into contact therewith to a greatly reduced degree compared to an aerosol flow with a through-flow parallel to the scattered light plane, this avoids contamination of the sensing means or at least greatly reduces the degree of contamination over time. Due to the absence, or at least reduction, of contamination, this enables a reference detector arranged in this manner to be used much longer for the calibration of the at least one smoke detector to be calibrated than would be the case with a through-flow with an aerosol flow parallel to the scattered light plane. Longer usage life of the at least one reference detector also avoids the need for additional handling steps to carry out the method (exchange of a contaminated reference detector and replacement by a new or cleaned reference detector) and accordingly facilitates the operation of the calibration device.

Every reference in respect of the description of aspects of dependent claims should also be expressly deemed to be a description of optional features without any special reference. Finally, reference should be made to the fact that the calibration method disclosed here can also be developed in accordance with the dependent device claims and vice versa.

In some embodiments, the aerosol flowing through the channel flows through the reference detector in the channel transversely to the scattered light plane of the reference detector in that the respective reference detector is placed in the channel without a housing surrounding the sensing means of the reference detector. The removal of the housing or the use of smoke detectors as reference detectors that have never been inserted into a housing is a particularly simple measure of ensuring through-flowability transverse to scattered light plane.

In some embodiments, the reference detector (in particular without a housing surrounding the sensing means of the reference detector) in each case is placed in or is in a reference detector housing belonging to the channel. Such a reference detector housing makes it possible to ensure secure holding of the reference detector in an orientation through which a flow passes transverse to its scattered light plane. In some embodiments, the internal volume of the reference detector housing is matched to the space required by the reference detector thus avoiding turbulence in the aerosol flow due to unnecessarily large volumes that would otherwise have to dealt with. The interior of the reference detector housing, in particular the inner surface of the reference detector housing, optionally contains holders for fixing the reference detector in the aforementioned orientation.

In some embodiments, to obtain the same scattering angles, an orientation of the scattered light transmitter of the reference detector is, or can be, adapted to an orientation of a corresponding scattered light transmitter of the at least one smoke detector. Such adaptability enables particularly simple and flexible adaptation of the reference detector to the at least one smoke detector to be calibrated. This also makes it possible to use as a reference detector a reference detector that does not exactly correspond to the type of the smoke detector to be calibrated. Instead, an adaptation of the orientation of the scattered light transmitter or at least one scattered light transmitter causes the respective reference detector to be given a configuration with exactly the same scattering angles as the smoke detector to be calibrated.

In some embodiments, the at least one reference detector is located in the channel, in particular in a reference detector housing, upstream of the at least one smoke detector to be calibrated and, in a corresponding embodiment of the calibration device, the at least one reference detector can be placed in the channel upstream of the at least one smoke detector to be calibrated.

In some embodiments, an already calibrated smoke detector that functions as a further reference detector is located in the channel and preferably downstream of the at least one smoke detector to be calibrated (in particular in a reference detector housing), wherein data that can be received by the further reference detector is used together with data that can be received by the reference detector to check and/or correct the calibration of the at least one smoke detector to be calibrated. The check can, for example, consist in the fact that—as described below—the calibration of the at least one smoke detector is only performed when the reference detector and the at least one further reference detector supply substantially the same sensor signals so that is accordingly possible to assume that there is a uniform distribution of the aerosol in the channel. The calibration can be checked in that an average of the calibration signals that can be received by the at least two reference detectors is used for the calibration.

In some embodiments, the automatic detection of a uniform distribution of the aerosol in the channel consists in that fact that a temporal change in a sensor signal that can be received by the reference detector and/or the at least one smoke detector to be calibrated is monitored.

In some embodiments, the calibration is performed iteratively with a predefined or predefinable number of steps. In each individual step, the at least one smoke detector to be calibrated is calibrated as described here and in the following. It is expected that, after a first step, the sensor signal that can be received by the smoke detector to be calibrated corresponds more closely to the reference signal. In a second step and further steps, a new calibration is performed based on the now up-to-date reference and sensor signals. This iterative calibration method is complete when the respective number of steps is reached and/or aborted when the sensor signal of the smoke detector to be calibrated matches the reference signal within predefined or predefinable limits.

In some embodiments, a calibration device of the type described above comprises a control unit that determines the essential functions of the calibration device. The control unit is hence an example of means comprised by the calibration device for carrying out the calibration method and optionally special embodiments of the calibration method. The control unit can be used to execute a computer program functioning as a control program and is embodied to carry out the calibration method that effects the calibration of the at least one smoke detector. Hence, the invention is, on the one hand, also a computer program with program code instructions that can be carried out by a computer and, on the other, a storage medium with a computer program of this kind, i.e. a computer program product with program code means, and finally also a control unit or a calibration device into the memory of which such a computer program is, or can be, loaded as means for carrying out the method.

Where the following describes method steps or sequences of method steps this relates to actions that take place as a result of the control program or under the control of the control program unless express reference is made to the fact that individual actions are performed by an operator of the calibration device. At least, each use of the term "automatically" means that the relevant action is performed as a result of the computer program or under the control of the computer program.

Instead of a computer program with individual program code instructions, the method described here and, in the following, can also be implemented in the form of firmware. It is clear to the person skilled in the art that, instead of implementing a method in software, implementation in firmware or in firmware and software or in firmware and hardware is always also possible. Therefore, for the purposes of the description provided here, it should be understood that the term software or the terms control program and computer program also encompass other implementation possibilities, namely in particular implementation in firmware or in firmware and software or in firmware and hardware. In some embodiments, the channel for accommodating the at least one smoke detector to be calibrated comprises a smoke detector housing (or in each case a respective smoke detector housing or f smoke detector to be calibrated) and in each case a reference detector housing for accommodating the reference detector. The housings comprised by the channel (smoke detector housing, reference detector housing) are connected to each other by means of individual channel sections. Herein, each output side of a housing is connected to an input side of a following (downstream) housing along the channel in the direction of flow. Therefore, the aerosol flow that enters one of the housings travels to the following downstream housing in each case. In some embodiments, the reference detector housing is intended and configured to accommodate a reference detector in precisely one orientation, namely an orientation in which an aerosol flowing through the channel flows through the reference detector in the channel transversely to the scattered light plane of the reference detector. Placing the reference detector in its own reference detector housing ensures that that the respective reference detector is fixed in the desired orientation.

In some embodiments, a channel section connected upstream to the reference detector housing or to one of the reference detector housings extends piece-by-piece into the reference detector housing. Herein, the channel section extending piece-by-piece into the reference detector housing acts like a nozzle with respect to the concentration of the aerosol flow on the scattered light region. This affects a concentration of the aerosol flow on a scattered light region of the reference detector located in the reference detector housing. The sensing means of the reference detector defines the scattered light region but is itself located outside the scattered light region. Consequently, concentrating the aerosol flow on the scattered light region causes the aerosol flow to be kept away from the sensing means of the reference detector. This prevents contamination of the sensing means due to turbulence of the aerosol in the interior of the reference detector housing that would otherwise have to be dealt with. Such a concentration of the aerosol flow at least reduces contamination of the sensing means that would otherwise have to be dealt with. The length of the channel section extending into the reference detector housing can be dimensioned such that the channel section terminates just above the scattered light plane. In any case, the channel section does not extend into the scattered light plane.

In some embodiments, to concentrate the aerosol flow on the scattered light region, an effective cross section of a channel section connected downstream to the reference detector housing or to one of the reference detector housings is larger than an effective cross section of a channel section connected upstream to the same reference detector housing. The different effective cross sections on the input side and on the output side of the reference detector housing result in a pressure difference between the input side and the output side and the resulting lower pressure on the output side effects the concentration of the aerosol flow on the scattered light region.

The following describes an example embodiment of the teachings herein in more detail with reference to the drawings. Objects or elements corresponding to each other are given the same reference numbers in all the figures.

The example embodiment should not be understood as a restriction of the scope of the disclosure. Rather numerous variations and modifications are quite possible in the context of the present disclosure, in particular those which can be inferred by the person skilled in the art with regard to achieving the object, for example by combination or modification of individual features or method steps that are described in connection with the general or specific part of the description and are contained in the claims and/or drawing and, by way of combinable features, lead to a new subject matter or to new method steps or sequences of method steps.

The depiction in FIG. 1 shows—in a greatly simplified schematic description—a top view of a smoke detector 10. The smoke detector 10 comprises a housing 12, of which only the boundary line is shown, wherein the external shape of the housing 12 is expressly not restricted to a circular shape. The housing 12 contains a measuring chamber of the smoke detector 10 and, aligned toward the measuring chamber, the sensing means of the smoke detector 10, namely a scattered light receiver 14, for example a photodiode, and at least one scattered light transmitter 16. In the embodiment depicted, the smoke detector 10 comprises two scattered light transmitters 16 and the further description—without dispensing with any further general validity—will be continued using the example of a smoke detector 10 with a plurality of scattered light transmitters 16. A smoke detector 10 with only one scattered light transmitter 16 is also possible and each mention of a plurality of scattered light transmitters 16 should always also be understood to mean a smoke detector 10 with only one scattered light transmitter 16.

In some embodiments, scattered light transmitters 16 may comprise, for example, LEDs or laser diodes. The scattered light transmitter 16 is directed at a region of the measuring chamber in the interior of the smoke detector 10, which is hereinafter called a scattered light region 20. There, the light emitted by the scattered light transmitters 16 could possibly be deflected (reflected) due to particles 22 located in the scattered light region 20, for example smoke particles, and, in the case of such a deflection, travels at least partially to the scattered light receiver 14. The light intensity sensed by the scattered light receiver 14 is a measure for a possible alarm signal triggered by the smoke detector 10. To operate the sensing means (scattered light receiver 14, scattered light transmitter 16) and to evaluate a sensor signal of the scattered light receiver 14, the smoke detector 10 comprises in a manner that is known per se electronic means that are not shown here, for example on and in the form of a printed circuit board, which also functions as a carrier for the sensing means.

In some embodiments, the housing 12 of the smoke detector 10 is shaped in a manner such that no ambient light enters the interior of the smoke detector 10. However, the housing 12 does permit the ingress of ambient air and hence, possibly also the ingress of smoke, into the interior of the smoke detector 10.

Figure 2:
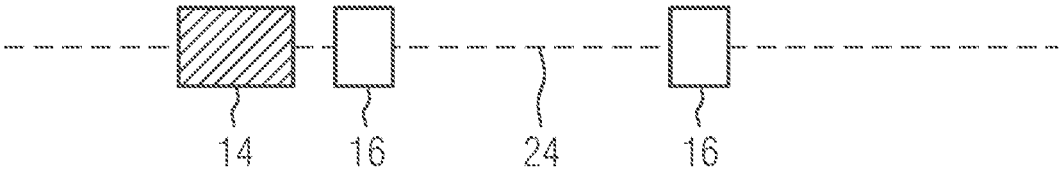
FIG. 2 shows the smoke detector according to FIG. 1 that can also be used as a reference detector in a side view, wherein a scattered light plane defined by the sensing means is plotted in the side view.

The depiction in FIG. 2 shows the smoke detector 10 according to FIG. 1 without the housing 12 and in a section along the line of intersection II-II plotted in FIG. 1. Here, once again, only the sensing means (scattered light receiver 14, scattered light transmitter 16) of the smoke detector 10 are shown. It may be identified that the sensing means is located in one plane or at least substantially in one plane. Hereinafter, the plane is called the scattered light plane 24.

The older European patent application entitled "Method and device for calibrating a smoke detector" (official filing reference 17167059.9; filing date: Apr. 19, 2017) discloses, for the calibration of a smoke detector 10 according to FIG. 1 and FIG. 2, a method for the automatic calibration (calibration method) of at least one smoke detector 10 and for the further description reference is made to FIG. 3 originating from this older application. The following is provided with the method: the at least one smoke detector 10 to be calibrated is placed in a channel 28 exposed to a volume flow comprising an aerosol (test aerosol) 26. In the depiction in FIG. 3, the aerosol flow 26 is illustrated by block arrows. Together with the at least one smoke detector 10 to be calibrated, the channel 28 contains at least one already calibrated smoke detector 10, in particular of the same type, that functions as a reference detector 30. The automatic calibration of the at least one smoke detector 10 takes place in that it is calibrated by means of data is that can be received by the reference detector 30 or reference detectors 30. Therefore, the calibration of the at least one smoke detector 10 can take place automatically and takes place by means of at least one already calibrated smoke detector that functions as a reference detector 30. Calibration is this way is comparatively simple and can also be implemented with comparatively low expenditure on equipment. No special sensing means are required because the reference detector 30 functions as sensing means. Following calibration, the calibrated smoke detector 10 is replaced by a new smoke detector to be calibrated 10. This can be continued repeatedly.

The channel 28 comprises a plurality of individual flow-through housings 32 in each case for accommodating a smoke detector 10, i.e. for accommodating either a smoke detector functioning as a reference detector 30 or a smoke detector to be calibrated 10. The housings 32 are connected to each other with flow-through channel sections 34 in the form of pipeline sections or the like. As a result of the housings 32 tightly surrounding the respective smoke detector 10 (or reference detector 30), the aerosol flowing 26 through the channel 28 fills the measuring chambers of all detectors 10, 30 uniformly in a short time thus establishing sufficiently similar conditions for the calibration of the at least one smoke detector 10.

The calibration is a calibration in the sense of adjustment and comprises at least one measurement and an intervention into the smoke detector 10 to be calibrated depending upon the result of the measurement. The measurement at least supplies the data that can be received by the reference detector 30, which is, for example, used as a standard. The intervention in the smoke detector to be calibrated 10 adapts it in accordance with the data that can be received by the reference detector 30. The calibration preferably take place automatically. Insofar, the intervention in the smoke detector to be calibrated 10 takes place, for example, in the form of the adaptation of data stored in the smoke detector 10.

In some embodiments, the channel 28 contains a smoke detector functioning as a reference detector 30 upstream of the at least one smoke detector to be calibrated 10 and also a smoke detector functioning as a reference detector 30 downstream of the at least one smoke detector to be calibrated 10. With such a configuration, the calibration of the at least one smoke detector to be calibrated 10 takes place, for example, as soon as both reference detectors 30 supply the same measured values and it is consequently possible to assume that a uniform aerosol concentration has become established in the channel 28 between the upstream reference detector 30 and the downstream reference detector 30. The aforenamed older application and, with this reference, this approach is incorporated in its entirely in the description presented here with respect to the calibration of a smoke detector to be calibrated 10 using the data that can be received by at least one other smoke detector functioning as a reference detector 30.

In some embodiments, the aerosol flowing 26 through the channel flows through the reference detector 30 located in the channel 28 parallel or at least substantially parallel to the scattered light plane 24 (FIG. 2). Herein, the sensing means of the respective smoke detector functioning as a reference detector 30 comes into contact with the aerosol 26. This can result in contamination of the sensing means of the reference detector 30. In the case of contaminated sensing means, in some circumstances, the sensor signal that can be received by the reference detector 30 is no longer sufficiently accurate for the calibration of a smoke detector to be calibrated 10. In some embodiments, the system avoids, or at least significantly reduces, any possible contamination of the sensing means of the reference detector 30. To this end, it is—in short—provided that in the channel 28, the aerosol flowing 26 through the channel 28 flows through the reference detector 30 perpendicularly or at least substantially perpendicularly to the scattered light plane 24, as shown in a simplified schematic depiction in FIG. 4.

Figure 3:
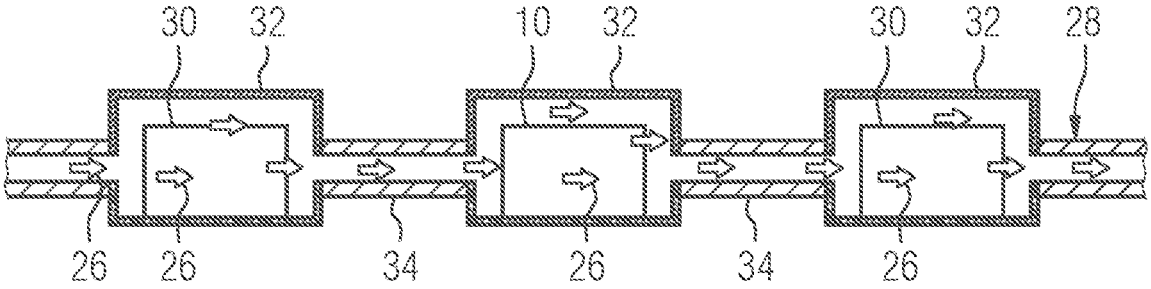
FIG. 3 shows a side view of a device for the calibration of at least one smoke detector (calibration device) by means of at least one smoke detector functioning as a reference detector incorporating teachings of the present disclosure.
Figure 4:
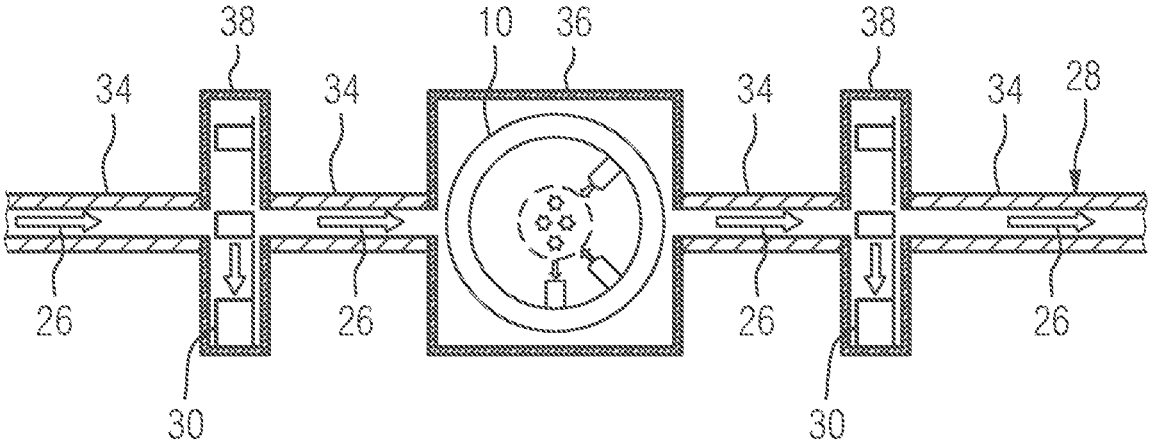
FIG. 4 shows a calibration device incorporating teachings of the present disclosure in a top view, wherein the suggested special orientation of the at least one smoke detector functioning as a reference detector is identifiable in the top view.

As in FIG. 3, the depiction in FIG. 4 shows a channel 28 through which an aerosol 26 flows during operation. Unlike the depiction in FIG. 3, in FIG. 4 the channel 28 and the smoke and reference detectors 10, 30 located therein are shown in a top view. The channel 28 comprises a plurality of housings 32 arranged one after the other in the direction of flow of the aerosol 26 (FIG. 3). For purposes of differentiation, the housings 32 comprised by the channel 28 are referred to as either smoke detector housings 36 or as reference detector housings 38. A smoke detector to be calibrated 10 is in each case located in the or a smoke detector housing 36. A smoke detector functioning as a reference detector 30 is in each case located in the reference detector housing 38. In the reference detector housing 38, the respective reference detector 30 is arranged and oriented such that the aerosol flowing 26 through the channel 28 flows therethrough transversely or at least substantially transversely to the scattered light plane 24 of the respective reference detector 30. To enable such a through-flow, the reference detector 30 is preferably located in the reference detector housing 38 without the surrounding housing 12 (FIG. 1) (i.e. only the scattered light arrangement of the reference detector 30). It is easily possible to dispense with the housing 12 in the context of the calibration because the reference detector housing 38 and at least also the channel sections 34 to be connected directly thereto are opaque so that, to a certain extent, the reference detector housing 38 of the channel 28 replaces the housing 12 that would otherwise surround the sensing means of the reference detector. The reference detector 30 is, for example, held in the reference detector housing 38 in that side edges of the printed circuit board of the reference detector 30 engage in guidance means located or formed in the interior of the reference detector housing 38.

Figure 5:
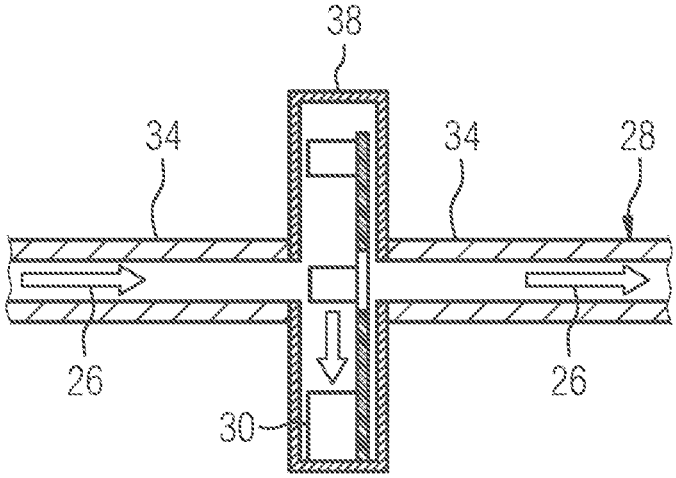
FIGS. 5-7 show variants of a reference detector housing of the calibration device according to FIG. 4 intended to accommodate a reference detector.
Figure 6:
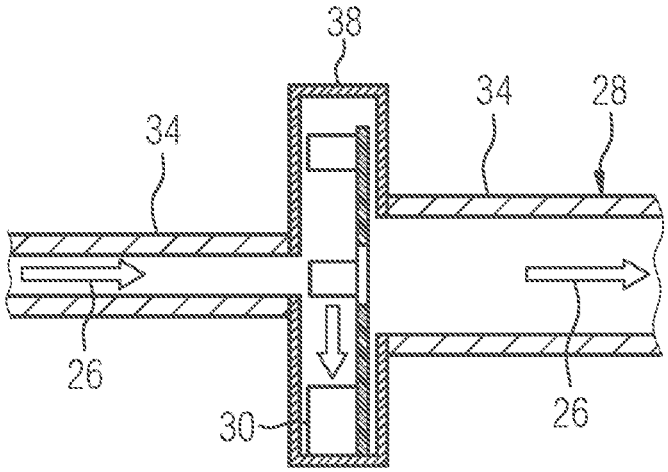
Figure 7:
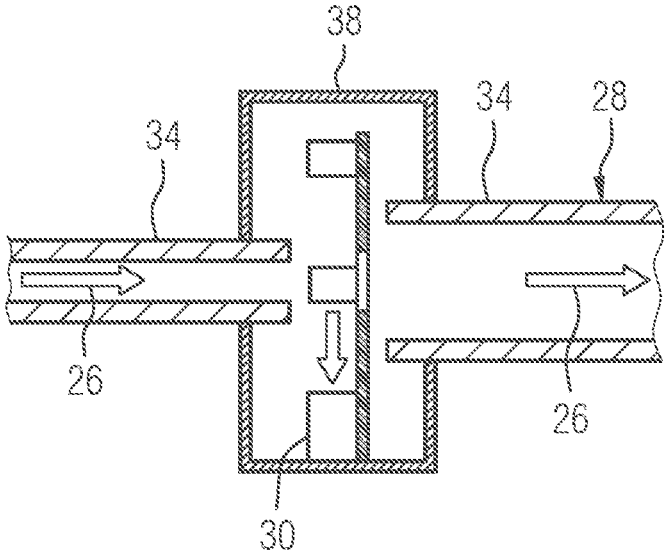

The depictions in FIG. 5 to FIG. 7 show additional examples for concentration of the aerosol flowing through a reference detector housing 38 on a region that does not reach, or at least does not substantially reach, the sensing means, i.e. for example on the scattered light region 20 shown in FIG. 1.

FIG. 5 shows for purposes of comparison a reference detector housing 38 and a reference detector 30 located therein as shown in FIG. 4. FIG. 6 shows an embodiment in which the channel section 34 connected to the reference detector housing 38 downstream of the reference detector housing 38 has a larger effective diameter than the upstream channel section 34 preceding the reference detector housing 38. The difference in the cross-section results in a low pressure downstream of the reference detector 30 located in the reference detector housing 38. This pressure difference effects a concentration of the incoming aerosol flow on, or at least substantially on, the scattered light region 20 and prevents or reduces turbulence of the aerosol flow in the interior of the reference detector housing 38. Concentration takes place because the upstream channel section 34 connected to the reference detector housing 38 points toward the scattered light region 20 and hence the aerosol flow is directed at the scattered light region 20.

FIG. 7 shows a further embodiment for concentrating the incoming aerosol flow on the scattered light region 20. According to this, it is provided that the incoming channel section 34 and the outgoing channel section 34, i.e. the upstream or downstream channel section 34, extend into in the reference detector housing 38 and there also effect a concentration of the aerosol flow on, or at least substantially on, the scattered light region 20 and prevent, or at least reduce, turbulence of the aerosol flow in the interior of the reference detector housing 38.

The embodiment shown in FIG. 7 shows a combination of a plurality of measures that effect such a concentration of the aerosol flow and a reduction of turbulence. For example, different cross sections of the incoming and the outgoing channel section 34 give rise to a pressure difference such as that described in connection with the explanation of the embodiment depicted in FIG. 6. Moreover, not only the incoming channel section 34, but also the outgoing channel section 34, extends into the interior of the reference detector housing 38 and, finally, the reference detector housing 38 in the direction of flow of the aerosol 26 is wider than in the embodiments shown above. All of these measures are also possible individually. For example, also conceivable is an embodiment in which only the incoming channel section 34 extends in a nozzle-like manner into the interior of the reference detector housing 38 and the cross sections of the incoming and outgoing channel section 34 are the same, or at least substantially the same. It is then optionally possible for the width of the reference detector housing 38 to be reduced in the direction of flow thus resulting in a width that lies approximately midway between the width shown in FIG. 6 and FIG. 7.

In some embodiments, the boundary line of the incoming channel section 34 is in alignment with the boundary of the scattered light region 20. This is the case when an axial projection of the lateral surface of the incoming channel section 34, in particular an axial projection of the interior lateral surface of the incoming channel section 34, onto the scattered light plane 24 coincides, or at least substantially coincides, with the boundary line of the scattered light region 20.

Figure 8:
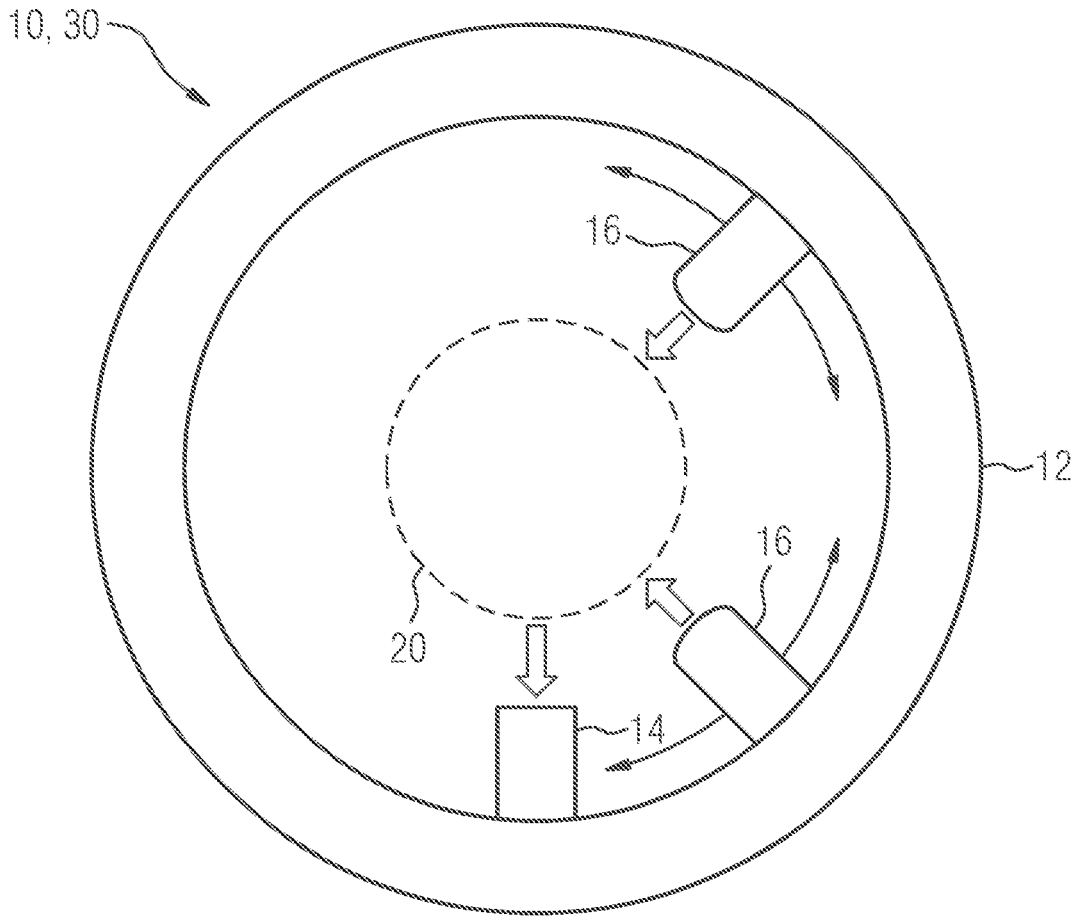
FIG. 8 shows a reference detector incorporating teachings of the present disclosure in a top view with scattered light transmitters that are adjustable with respect to their position and FIGS. 9-10 show the calibration device according to FIG. 4 with a control unit intended for the automatic calibration of at least one smoke detector to be calibrated.

The depiction in FIG. 8 shows a depiction substantially as in FIG. 1. As in FIG. 1—this shows a smoke detector 10 in a top view. However, the depiction primarily relates to a smoke detector functioning as a reference detector 30 or a scattered light arrangement functioning as a reference detector 30. For this, it is provided that a scattering angle resulting from a position of the scattered light transmitters 16 can be adjusted. This adjustability is enabled in that the scattered light transmitter 16, at least one scattered light transmitter 16 scattered light transmitter 16 can be moved around the centre of the scattered light region 20 as illustrated in the depiction by the arrows emerging from the scattered light transmitters 16.

Setting the scattering angle enables the smoke detector functioning as a reference detector 30 (the scattered light arrangement functioning as a reference detector 30) to be adapted to the smoke detector to be calibrated 10. An adaptation of the wavelength of the light emitted by the scattered light transmitters 16 that may be necessary can be achieved by changing to other scattered light transmitters 16, for example changing to other LEDs or laser diodes. Alternatively to such a change of the scattered light transmitters 16, it is also possible that, from a plurality of scattered light transmitters 16 arranged along a circumferential line around the scattered light region 20, in each case the scattered light transmitter or transmitters 16 to be selected (to be activated; all other scattered light transmitters 16 are or will be then deactivated) are those that can be used for a calibration of the smoke detector to be calibrated 10.

Figure 9:
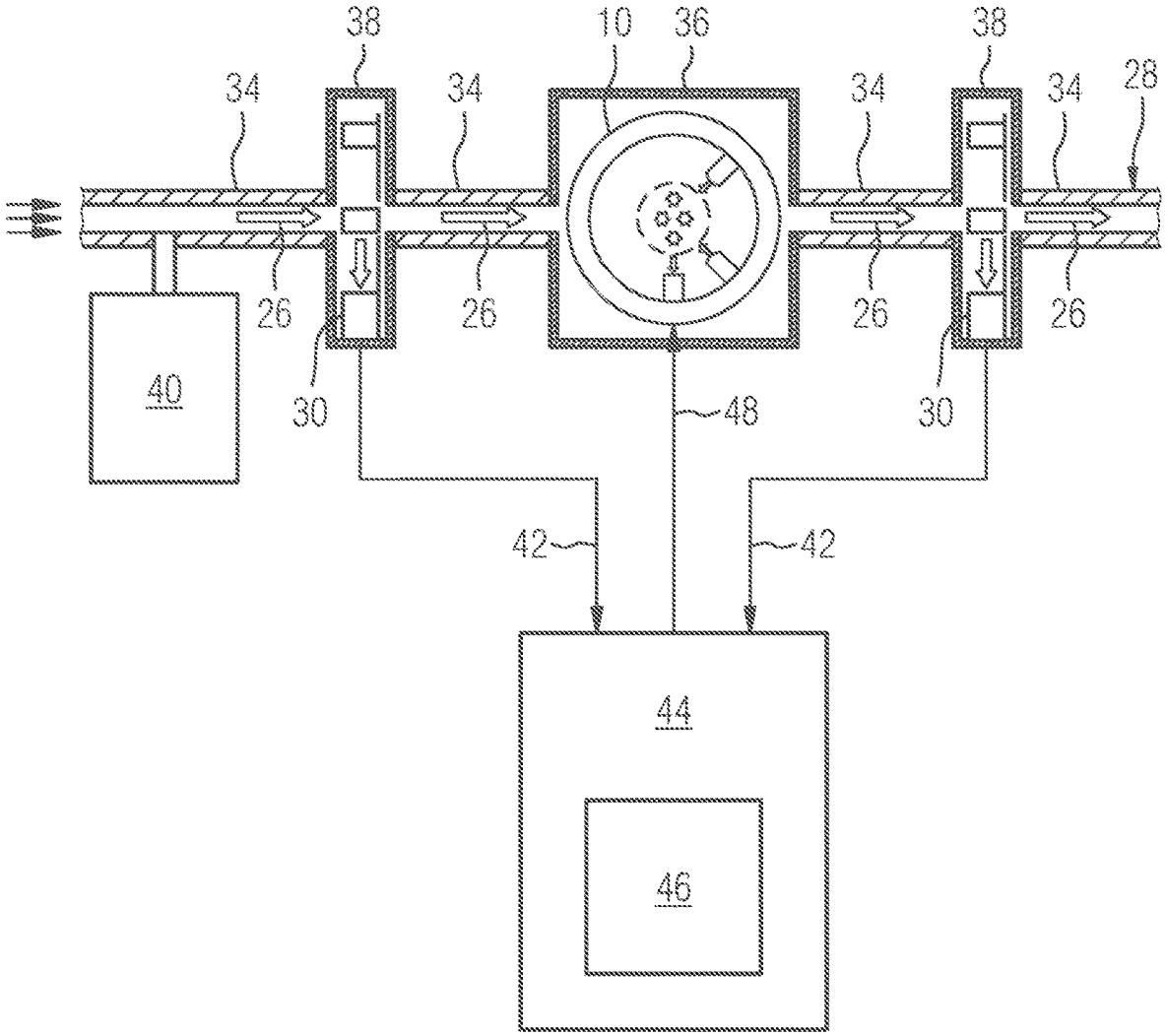
Figure 10:
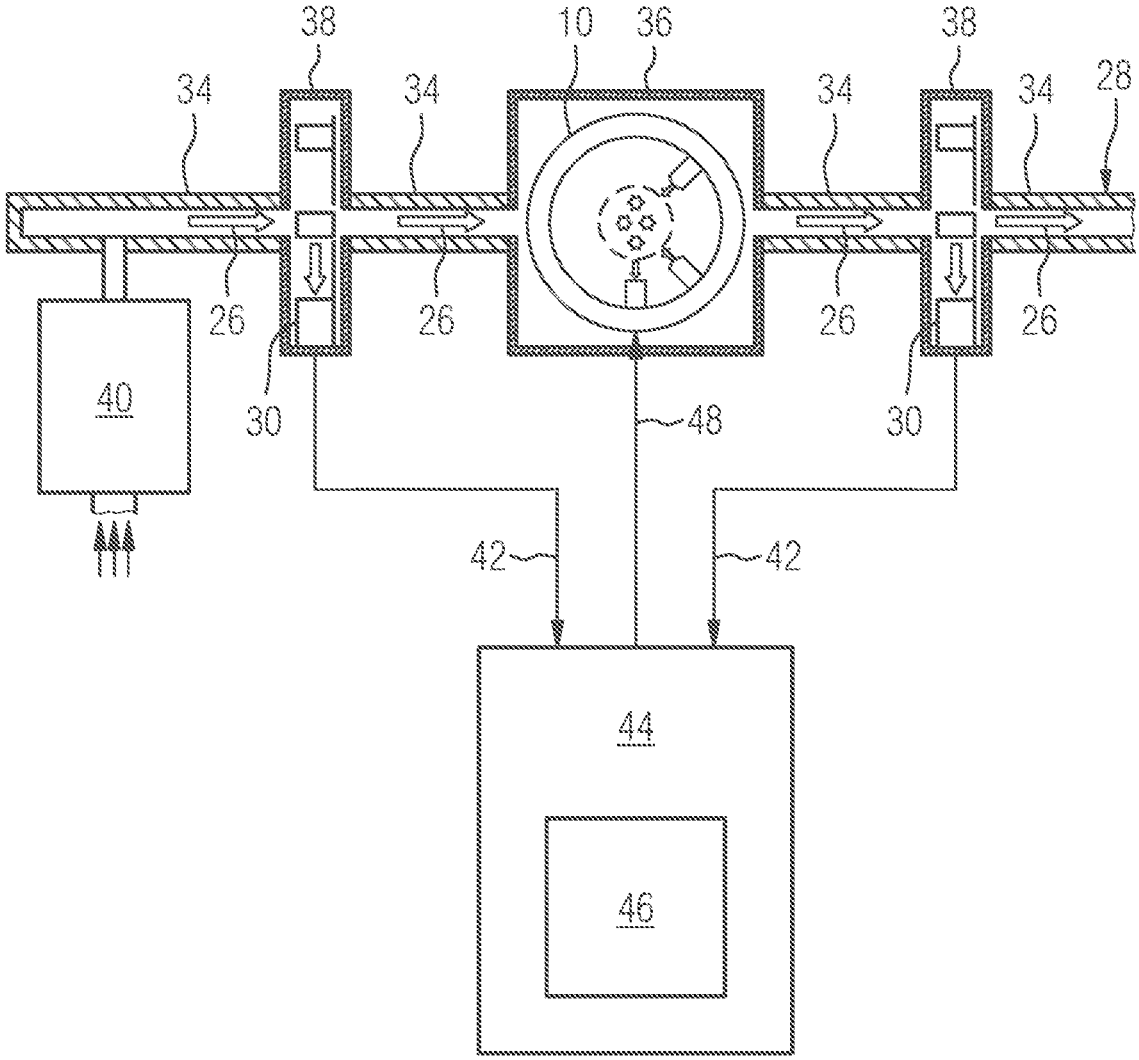

The depictions in FIG. 9 and FIG. 10 show a depiction that is substantially as in FIG. 4. These show a device functioning as a calibration device for the calibration of at least one smoke detector 10 in accordance with the approach suggested here. The device comprises a channel 28 that can be exposed to an aerosol flow (test aerosol) 26 in longitudinal section. During operation of the device, the aerosol 26 is generated by means of an aerosol generator 40 and emitted thereby into the interior of the channel 28. The aerosol 26 is uniformly distributed in the available volume in each case.

According to FIG. 9, the aerosol 26 is, for example, guided through the channel 28 by means of compressed air introduced into channel on the input side, for example by means of a fan or the like (not shown) thus resulting in an aerosol flow (volume flow) as illustrated in the depictions in FIG. 9 and FIG. 10 (and the preceding depictions in FIG. 4 and FIG. 5-7) by means of the block arrows.

According to FIG. 10, the aerosol 26 generated by means of the aerosol generator 40 and initially located in the interior of a housing of the aerosol generator 40 is drawn into the channel 28 by means of a vacuum.

A device according to FIG. 9 or FIG. 10 or a comparable device is intended for the automatic calibration of at least one smoke detector 10 (of the smoke detector to be calibrated 10). In addition to this at least one smoke detector to be calibrated 10, at least one already calibrated smoke detector functioning as a reference detector 30 is located in the channel 28. The reference detector 30 may be, but not necessarily, located upstream of the at least one smoke detector to be calibrated 10, namely upstream of the at least one smoke detector to be calibrated 10 in relation to the aerosol flow. The site of the inflow of the aerosol 26 is located upstream of the reference detector 30 and upstream of the smoke detector to be calibrated 10. The aerosol flow passes the reference detector 30 and the smoke detector to be calibrated 10 and there the respective scattered light region 20. There, the aerosol 26 is acquired by the sensing means of the reference detector 30 or smoke detector 10.

The device optionally enables the simultaneous calibration of a plurality of smoke detectors to be calibrated 10. Instead of exactly one smoke detector to be calibrated 10, depending upon the longitudinal extension of the channel 28, it is possible for a plurality of smoke detectors to be calibrated 10 to be placed in the device and, to be precise, either in one suitably large smoke detector housing 36 or a plurality of smoke detector housings 36. In the interest of better legibility, the description is worded on the basis of exactly one smoke detector to be calibrated 10 in the channel 28 and one smoke detector housing 36 surrounding the smoke detector. This enables expressions such as "at least one smoke detector to be calibrated 10" to be dispensed with. However, the possibility of a plurality of smoke detectors to be calibrated 10 in the channel 28 should always be understood and considered to be included in the description presented here. In view of the designation of the already calibrated smoke detector as a reference detector 30, the smoke detector to be calibrated 10 can hereinafter also be given the short designation smoke detector 10 while still retaining a clear distinction.

The calibration of the smoke detector 10 is based on the fact that the reference detector 30 is already calibrated and that the smoke detector 10 and the reference detector 30 are identical, or substantially identical, for example of the same design or type, or that such equality has been established by adaptation as described above in connection with the explanation of the depiction in FIG. 8. The fact that both the reference detector 30 and the smoke detector 10 are placed in the channel 28 downstream of the infeed of the aerosol 26 means that they are exposed to the same aerosol flow and, at least substantially, to the same aerosol concentration.

As a result of the aerosol 26, each smoke detector 10, and hence also the reference detector 30, generates a sensor signal that encodes a measure for the amount of aerosol in the measuring chamber thereof. Hereinafter, for differentiation, the sensor signal of the reference detector 30 is designated a reference signal 42. This is, for example, sent to a control unit 44 of the device. To this end, for example contact elements (not shown), which also determine the position intended for the reference detector 30, are located in the interior of each reference detector housing 38. The contact elements can be used to connect the control unit 44 in a communicative manner to the reference detector 30 and the communicative connection is at least used to transmit the reference signal 42 from the reference detector 30 to the control unit 44. The reference signal 42 can be read by the control unit 44, for example in the context of a so-called service protocol. The control unit 44 comprises in a manner that is fundamentally known per se a processing unit in the form of type of a microprocessor and a memory, into which a control program 46 executed by means of the processing unit is loaded during the operation of the device. The control program 46 comprises in a manner that is fundamentally known per se program code instructions and defines the nature of the processing of the reference signal 42 and the generation of a calibration signal 48. The calibration signal 48 is transmitted to the smoke detector 10 for the calibration thereof, for example also by means of the service protocol. For the communicative connection required therefor between the control unit 44 and the smoke detector 10, contact elements (not shown) for the smoke detector 10, which also determine the position intended for the smoke detector 10 are also located in the interior of the smoke detector housing 36.

In some embodiments, with a smoke detector 10—and consequently also a with smoke detector functioning as a reference detector 30—the detection of any smoke particles takes place on the basis of the scattering of light on the smoke particles. On the smoke particles, a test light beam emitted in the interior of the smoke detector 10, 30 is scattered by means of the scattered light transmitter 16 and scattered light arrives at a photosensitive sensor, the scattered light receiver 14. An alarm is triggered when at least one sensor signal generated by the sensor, and possibly further processed, proportional to the light scattered on the smoke particles exceeds a defined reference value.

In some embodiments, such a sensor signal is used as a reference signal 42 by the reference detector 30. The reference signal 42 is proportional to the amount of aerosol arriving in the scattered light region 20 of the reference detector 30 as a result of the aerosol flow in the channel 28. In the case of an identical smoke detector 10 and a substantially constant volume flow in the channel 28, it can be assumed that, due to the aerosol flow in the channel 28, the same amount of aerosol arrives in the smoke detector 10 and the scattered light region 20 thereof. As a consequence, the sensor signal of the smoke detector 10 would have to correspond, or at least substantially correspond, to the sensor signal (reference signal 42) of the reference detector 30. Any deviation, in particular a deviation exceeding a predefined or predefinable limit value, is corrected by calibration of the smoke detector 10.

The calibration of the smoke detector 10 on the basis of the reference signal 42 that can be received by the reference detector 30 can take place in different ways. Individual options that are fundamentally possible for calibrating a smoke detector 10 are explained below—purely by way of example and without dispensing with any further general validity:

The smoke detector 10 can be set to a calibration mode by means of the control unit 44 and the control unit 44 can then transmit the reference signal 42 to the smoke detector 10 as a calibration signal 48. The reference signal 42 is then basically only forwarded by means of the control unit 44 to the smoke detector 10. The smoke detector 10 internally compares the calibration signal 48 with the sensor signal generated by its own sensing means and, if necessary, makes a correction, for example a correction of a calibration factor or at least one calibration factor. The calibration factor or the respective calibration factor is, for example, obtained as a quotient of the reference signal 42 and the internal sensor signal or generally on the basis of predefined processing of the reference signal 42 and the internal sensor signal. The calibration of the smoke detector is complete as soon as, after any adaptation of the calibration factor, the smoke detector 10 outputs the internal sensor signal weighted with the calibration factor as a sensor signal. Alternatively, it can be provided that the ratio of the reference signal 42 and the internal sensor signal is used to increase a pulse duration of the test light beam emitted periodically in the interior of the smoke detector 10 and/or to adapt the power of the scattered light transmitter 16 functioning as a test light source. In some embodiments, it is also possible to adapt an offset, an amplification and/or further parameters.

In the embodiment of the device for the automatic calibration of at least one smoke detector 10 shown in FIG. 9 and FIG. 10, in a fundamentally optional manner, the use of two reference detectors 30 is provided, namely one reference detector 30 upstream of the smoke detector 10 and one reference detector 30 downstream of the smoke detector 10. As already calibrated smoke detectors, the two reference detectors 30 would have to supply the same or at least substantially the same sensor signals (reference signal 42). As long as there is no uniformity or at least no sufficient uniformity, it cannot be assumed that the aerosol 26 is uniformly distributed in the channel 28. Accordingly, in the case of a device for the automatic calibration of at least one smoke detector 10 based on the use of two or more reference detectors 20, the control unit 44 only compares the reference signals 42 received by the reference detectors 30 and the calibration only starts when there is sufficient uniformity of the reference signals 42.

For example, under the control of the control program 46, the reference signal 42 received from the reference detector 30 is output as a calibration signal 48 to the at least one smoke detector to be calibrated 10. Each smoke detector 10, that receives the calibration signal 48 to a certain extent calibrates itself on the basis of the calibration signal 48 as already explained above. Alternatively, the ascertainment of a calibration factor of a smoke detector 10 can also be performed by the control unit 44. Then, the control unit 44 processes the reference signal 42 and the sensor signal of each smoke detector to be calibrated 10. The control unit 44, for example, forms the quotients and/or one or more correction factors and transmits these in the form of the calibration signal 48 to the respective smoke detector 10. Then, for example, the smoke detector 10 implements the value transmitted with the calibration signal 48 as an internal calibration factor or uses this to adapt a pulse duration of the test light beam emitted periodically in the interior of the smoke detector 10 and/or to adapt the power of the test light source.

In some embodiments, the control unit 44 automatically influences the aerosol concentration, for example by a corresponding activation of the aerosol generator 40 and/or by the activation of one or more switchable dilution stages. This enables the calibration of different types of smoke detector and/or smoke detectors 10 with a large dynamic range.

In the case of a plurality of reference detectors 30, the control program 46, for example, optionally comprises program code instructions for comparing the reference signals 42 that can be received by the reference detectors 30. Only when these match within a defined or definable time period in defined or definable limits, i.e. for example in that a difference between two reference signals 42 does not exceed a defined or definable reference value during the time period, does the calibration of the smoke detector to be calibrated 10 take place in that it is only then that the calibration signal 48 is automatically generated.

An additional or alternative possibility for the automatic start of the calibration consists in the fact that the control unit 44 monitors the sensor signal (reference signal 42) of at least one reference detector 30 and/or the sensor signal of at least one smoke detector 10 and the calibration only starts when a fluctuation of the respective sensor signal during a time interval with a defined or definable duration falls below a defined or definable limit value, i.e. when the monitored sensor signal or the monitored sensor signals no longer changes/change or only changes/change to a small degree. Then it can also be assumed the distribution of the aerosol 26 in the channel 28 is sufficiently uniform for the calibration.

The control program 46 then, for example, optionally comprises example program code instructions as a result of which it is automatically monitored whether the respective sensor signal does not change during a defined or definable time period, or only changes to a small degree. If this has been identified, calibration take place in that it is only then that the calibration signal 48 is automatically generated. According to a further optional embodiment, it can be provided that the start of the calibration is dependent upon the course of a waiting time with a defined or definable duration. The control program 46 then comprises program code instructions for maintaining the waiting time.

Although the teachings herein are illustrated and described in more detail by the exemplary embodiments, the scope of the teachings herein is not restricted by the disclosed example or examples and other variations can be derived herefrom by the person skilled in the art without departing from the scope of protection of the invention.

LIST OF REFERENCE NUMBERS

10 Smoke detector
12 (Smoke detector) housing
14 Scattered light receiver
16 Scattered light transmitter
18 (Free)
20 Scattered light region
22 Particles, smoke particles
24 Scattered light plane
26 Aerosol
28 Channel
30 Reference detector
32 Housing
34 Channel section
36 Smoke detector housing
38 Reference detector housing
40 Aerosol generator
42 Reference signal
44 Control unit
46 Control program
48 Calibration signal

The invention claimed is:

1. A method for the automatic calibration of a smoke detector, the method comprising:

mounting the smoke detector to be calibrated in a channel exposed to an aerosol flow, wherein a reference smoke detector has already been calibrated and located in the channel;

calibrating the smoke detector with data received by the reference detector;

wherein the reference detector comprises a scattered light receiver and a scattered light transmitter defining a scattered light plane; and wherein the aerosol flow through the channel flows through the reference detector transversely to the scattered light plane.

2. A method according to claim 1, wherein the reference detector has no housing surrounding the scattered light receiver and the scattered light transmitter.

3. A method according to claim 1, wherein the channel comprises a housing for mounting the reference detector.

4. A method according to claim 1, wherein an orientation of the scattered light transmitter matches an orientation of a corresponding scattered light transmitter of the smoke detector.

5. A device for the automatic calibration of a smoke detector, the device comprising:

a channel for an aerosol flow;

a mounting for the smoke detector to be calibrated to be positioned in the channel;

a reference smoke detector previously calibrated and placed in the channel;

a communication interface able to transmit data between the reference detector and the smoke detector to be calibrated;

wherein the reference detector comprises a scattered light plane defined by a scattered light receiver and a scattered light transmitter; and wherein the aerosol flow through the channel flows through the reference detector transversely to the scattered light plane.

6. A device according to claim 5, further comprising:

a smoke detector housing to mount the smoke detector in the channel;

a reference detector housing to mount the reference detector in the channel; and channel sections connecting the smoke detector housing and the reference detector housing such that each output side of a housing is connected to an input side of a downstream housing along the channel;

wherein the reference detector housing accommodates the reference detector in precisely one orientation in which the aerosol flow through the channel flows through the reference detector in the channel transverse to scattered light plane.

7. A device according to claim 6, wherein a first channel section upstream of the reference detector housing concentrates the aerosol flow in a scattered light region of the reference detector.

8. A device according to claim 6, wherein a second channel section connected downstream of the reference detector housing has a second cross section larger than a first cross section of a first channel section connected upstream of the reference detector housing.

9. A device according to claim 5, wherein a position of the scattered light transmitter of the reference detector is adjustable.

10. A device according to claim 5, further comprising:

a control unit; and a memory storing a computer program loaded for execution during the operation of the device by the control unit;

wherein the computer program, when executed, causes the control unit to:

receive sensor signals of the reference detector and the smoke detector to be calibrated; and process the received sensor signals for the calibration of the smoke detector.

* * * * *